US006643618B2

(12) United States Patent
Matsuoka et al.

(10) Patent No.: US 6,643,618 B2
(45) Date of Patent: Nov. 4, 2003

(54) SPEECH DECODING UNIT AND SPEECH DECODING METHOD

(75) Inventors: Bunkei Matsuoka, Tokyo (JP); Hirohisa Tasaki, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 314 days.

(21) Appl. No.: 09/842,095

(22) Filed: Apr. 26, 2001

(65) Prior Publication Data

US 2001/0029451 A1 Oct. 11, 2001

Related U.S. Application Data

(63) Continuation of application No. PCT/JP98/05529, filed on Dec. 7, 1998.

(51) Int. Cl.[7] ..... G10L 21/02
(52) U.S. Cl. ..... 704/228; 704/226; 370/289
(58) Field of Search ..... 704/226, 227, 704/228; 370/289

(56) References Cited

U.S. PATENT DOCUMENTS 5,587,998 A * 12/1996 Velardo, Jr. et al. ..... 370/289
5,809,460 A 9/1998 Hayata et al.
6,542,864 B2 * 4/2003 Cox et al. ..... 704/212

FOREIGN PATENT DOCUMENTS

| | | |
|---|---|---|
| JP | 54-139407 A | 10/1979 |
| JP | 5-122165 A | 5/1993 |
| JP | 7-129195 A | 5/1995 |
| JP | 8-314497 A | 11/1996 |
| JP | 8-321811 A | 12/1996 |
| JP | 9-18424 A | 1/1997 |
| JP | 10-39898 A | 2/1998 |

OTHER PUBLICATIONS

Research & Development Center for Radio System, "Digital Cellular Telecommunication System" RCR Standard. RCR STD–27, 4.1.19 VOX Control (translation of relevant portion).

* cited by examiner

*Primary Examiner*—Susan McFadden
(74) *Attorney, Agent, or Firm*—Rothwell, Figg, Ernst & Manbeck

(57) ABSTRACT

A speech decoding unit estimates coding parameters of a speech pause by carrying out smoothing algorithm of the coding parameters by using a coding parameter $x_{ref}$ constituting far-end talker background noise information extracted by a parameter extracting circuit 12, and a coding parameter $x_n$ used for synthesizing the previous background noise.

13 Claims, 10 Drawing Sheets

SPEECH DECODING UNIT AND SPEECH DECODING METHOD

CROSS-REFERENCE TO THE RELATED APPLICATION

This application is a continuation of International Application No. PCT/JP98/05529, whose international filing date is Dec. 7, 1998, the disclosures of which Application are incorporated by reference herein. The present application has not been published in English.

BACKGROUND OF THE INVENTION

1. Field of the Invention

The present invention relates to a speech decoding unit and a speech decoding method for reproducing far-end talker background noise when detecting speech pauses that do not contain speech of a far-end talker.

2. Description of Related Art

FIG. 1 is a block diagram showing a configuration of a conventional speech decoding unit disclosed in Japanese patent application laid-open No. 7-129195/1995, for example. In this figure, the reference numeral 1 designates an input terminal for inputting a speech code sequence; 2 designates an excitation signal generator for generating an excitation signal from the speech code sequence; 3 designates a speech spectrum coefficient generator for generating speech spectrum coefficients from the speech code sequence; 4 designates a synthesis filter for reproducing a speech signal from the excitation signal generated by the excitation signal generator 2 and the speech spectrum coefficients generated by the speech spectrum coefficient generator 3; 5 designates a speech spectrum coefficient buffer for holding the speech spectrum coefficients generated by the speech spectrum coefficient generator 3; 6 designates a speech spectrum coefficient interpolator for carrying out linear interpolation of the speech spectrum coefficients during speech pauses; 7 designates a speech output circuit for supplying the speech signal reproduced by the synthesis filter 4 to an output terminal 8; and 8 designates the output terminal.

Next, the operation of the conventional speech decoding unit will be described.

First, when a speech coder (not shown) detects speech of a far-end talker, it encodes the speech, and transmits the speech code sequence to the speech decoding unit.

When the speech of the far-end talker interrupts, the speech coder detects the speech pause of the far-end talker with an internal VOX (voice operated transmitter), and halts the transmission of the speech code sequence to the speech decoding unit. Instead, the speech coder transmits a unique word (post-amble POST) indicating the start of the speech pause and coding parameters indicating far-end talker background noise information.

During a speech burst in which the speech of the far-end talker is detected, the speech coder transmits the speech code sequence, so that in the speech decoding unit, the excitation signal generator 2 generates the excitation signal from the speech code sequence, and the speech spectrum coefficient generator 3 generates the speech spectrum coefficients from the speech code sequence.

When the speech burst begins because of the transition from the speech pause to the speech burst, the speech coder transmits a unique word called a preamble PRE so that the speech decoding unit can detect the start of the speech burst by detecting the unique word.

When the excitation signal generator 2 generates the excitation signal and the speech spectrum coefficient generator 3 generates the speech spectrum coefficients, the synthesis filter 4 reproduces the speech signal from the excitation signal and speech spectrum coefficients.

Then, the speech output circuit 7 supplies the speech signal reproduced by the synthesis filter 4 to the output terminal 8.

On the other hand, during the speech pause in which the speech of the far-end talker is not detected, although the speech coder halts the transmission of the speech code sequence, it transmits a unique word (post-amble POST) indicating the start of the speech pause, followed by the coding parameters indicating the far-end talker background noise information, so that in the speech decoding unit, the speech spectrum coefficient generator 3 generates the speech spectrum coefficients from the coding parameters indicating the far-end talker background noise information, and the excitation signal generator 2 continuously generates the excitation signal from the speech code sequence received in the final receiving period of the speech burst.

When the speech pause begins because of the transition from the speech burst to speech pause, since the speech coder transmits the unique word called a post-amble POST as described above, the speech decoding unit can detect the start of the speech pause by detecting the unique word (see, FIG. 2).

When the speech pause is detected, the synthesis filter 4 reproduces the speech signal from the excitation signal generated by the excitation signal generator 2 and from the far-end talker background noise information (speech spectrum coefficients) generated by the speech spectrum coefficient generator 3. However, if there is an acute difference between the far-end talker background noise information and the speech code sequence received in the final receiving period of the preceding speech burst, the reproduced speech signal varies sharply, thereby presenting a problem of reproducing uncomfortable background noise to the near-end listener.

In view of this, when the speech pause is detected, the speech spectrum coefficient interpolator 6 carries out linear interpolation of the speech spectrum coefficients (see, ☆ mark of FIG. 2), that is, the far-end talker background noise information received after the post-amble POST as shown in FIG. 2.

More specifically, if the synthesis filter 4 reproduces the speech signal using the far-end talker background noise information from the very beginning of the speech pause, the speech signal can change abruptly at the transition from the speech burst to the speech pause. Thus, to gradually vary the speech signal from the beginning of the speech pause to the update of the far-end talker background noise information (at the time when the next far-end talker background noise information is transmitted), a constant is added stepwise to the speech code sequence received in the final receiving period of the speech burst (the speech spectrum coefficients held in the speech spectrum coefficient buffer 5) to update the speech code sequence at fixed interpolation intervals (linearly increasing or decreasing the speech code sequence).

Using the far-end talker background noise information (speech spectrum coefficients) passing through the linear interpolation, the synthesis filter 4 reproduces the speech signal so that the speech output circuit 7 supplies the speech signal to the output terminal 8.

With the foregoing arrangement, the conventional speech decoding unit linearly interpolates the background noise information when the speech pause is detected, so as to vary the speech signal gradually. However, since the interpolation interval of the far-end talker background noise information is fixed at every frame interval, this presents a problem in that a near-end listener feels variations in the reproduced background noise to be monotonous and uncomfortable.

The present invention is implemented to solve the foregoing problem. Therefore, an object of the present invention is to provide a speech decoding unit and a speech decoding method capable of reproducing background noise with little uncomfortable feeling to the near-end listener.

SUMMARY OF THE INVENTION

The speech decoding unit in accordance with the present invention estimates coding parameters of a speech pause by carrying out a smoothing algorithm using coding parameters constituting far-end talker background noise information extracted by an extracting means and coding parameters that are used for synthesizing previous background noise.

This offers an advantage of being able to reproduce background noise with little uncomfortable feeling.

The speech decoding unit in accordance with the present invention can comprise an estimating means for estimating the coding parameters of the speech pause by substituting, into a prescribed equation, the coding parameters that are the far-end talker background noise information and the coding parameters that are used for synthesizing the previous background noise.

This offers an advantage of being able to carry out the smoothing algorithm of the coding parameters quickly without using a complicated configuration.

The speech decoding unit in accordance with the present invention can comprise a synthesizing means for synthesizing, in the initial receiving period of the speech pause, speech from coding parameters extracted from the final receiving period of the speech burst.

This offers an advantage of being able to eliminate a problem in that the background noise sharply changes in the initial receiving period of the speech pause.

The speech decoding unit in accordance with the present invention can carry out the smoothing algorithm of spectrum envelope information constituting a part of the coding parameters.

This offers an advantage of being able to reduce the arithmetic amount when there are coding parameters unnecessary for the smoothing algorithm.

The speech decoding unit in accordance with the present invention can carry out the smoothing algorithm of frame energy information constituting a part of the coding parameters.

This offers an advantage of being able to eliminate a problem in that the synthesized speech power of the background noise changes intermittently in response to the frame energy of the far-end talker background noise.

The speech decoding unit in accordance with the present invention can carry out the smoothing algorithm of spectrum envelope information and frame energy information constituting a part of the coding parameters.

This offers an advantage of being able to reproduce background noise with less uncomfortable feeling to the near-end listener.

The speech decoding unit in accordance with the present invention can comprise an estimating means for determining a smoothing coefficient of the coding parameters in response to variations between coding parameters extracted by the extracting means in the final receiving period of the speech burst and the coding parameters constituting the far-end talker background noise information extracted by the extracting means in a receiving period of the speech pause.

This offers an advantage of being able to reproduce background noise with less uncomfortable feeling because more appropriate smoothing coefficient of the coding parameters is obtained.

The speech decoding unit in accordance with the present invention can determine a smoothing coefficient of the coding parameters in response to variations between spectrum envelope information extracted in the final receiving period of the speech burst and the spectrum envelope information constituting the far-end talker background noise information, or in response to variations between the frame energy information extracted in the final receiving period of the speech burst and the frame energy information constituting the far-end talker background noise information.

This offers an advantage of being able to reproduce the background noise with little uncomfortable feeling without imposing a large load on the decision processing of the smoothing coefficient.

The speech decoding unit in accordance with the present invention can determine a smoothing coefficient of the spectrum envelope information in response to variations between the spectrum envelope information extracted in the final receiving period of the speech burst and the spectrum envelope information constituting the far-end talker background noise information, and determine a smoothing coefficient of the frame energy information in response to variations between frame energy information extracted in a final receiving period of the speech burst and the frame energy information constituting the far-end talker background noise information.

This offers an advantage of being able to reproduce background noise with less uncomfortable feeling to the near-end listener because the smoothing coefficient is determined in higher accuracy.

The speech decoding method in accordance with the present invention detects a speech pause by supervising a speech code sequence; and estimates, when the speech pause is detected, coding parameters of the speech pause by carrying out a smoothing algorithm of coding parameters by using coding parameters constituting the far-end talker background noise information extracted from the speech coding sequence and coding parameters used for synthesizing previous background noise.

This offers an advantage of being able to reproduce background noise with little uncomfortable feeling to the near-end listener.

The speech decoding method in accordance with the present invention can estimate the coding parameters of the speech pause by substituting, into a prescribed equation, the coding parameters constituting the far-end talker background noise information and the coding parameters used for synthesizing the previous background noise.

This offers an advantage of being able to carry out the smoothing algorithm of the coding parameters quickly without using a complicated configuration.

The speech decoding method in accordance with the present invention can synthesize, in the initial receiving period of the speech pause, speech from coding parameters extracted from the final receiving period of the speech burst.

This offers an advantage of being able to eliminate a problem in that the reproduced or synthesized background noise sharply changes in the initial receiving period of the speech pause.

The speech decoding method in accordance with the present invention can determine a smoothing coefficient of the coding parameters in response to variations between coding parameters extracted in the final receiving period of the speech burst and the coding parameters constituting far-end talker background noise information extracted in a receiving period of the speech pause.

This offers an advantage of being able to reproduce background noise with less uncomfortable feeling to the near-end listener because more appropriate smoothing coefficient of the coding parameters is obtained.

DETAILED DESCRIPTION OF THE PREFERRED EMBODIMENTS

The best mode for carrying out the invention will now be described with reference to the accompanying drawings.

Embodiment 1

Figure 1:
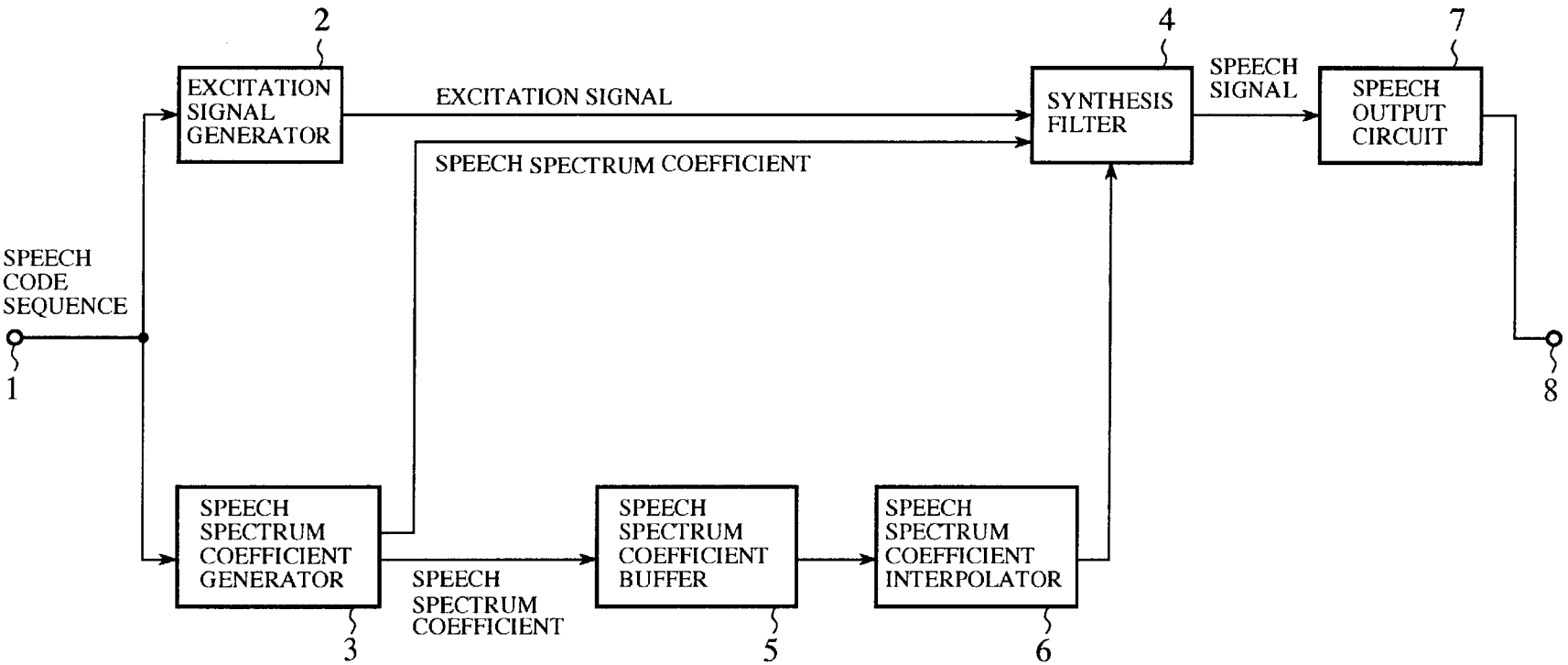
FIG.1 (PRIOR ART)
FIG. 1 is a block diagram showing a configuration of a conventional speech decoding unit.
Figure 2:
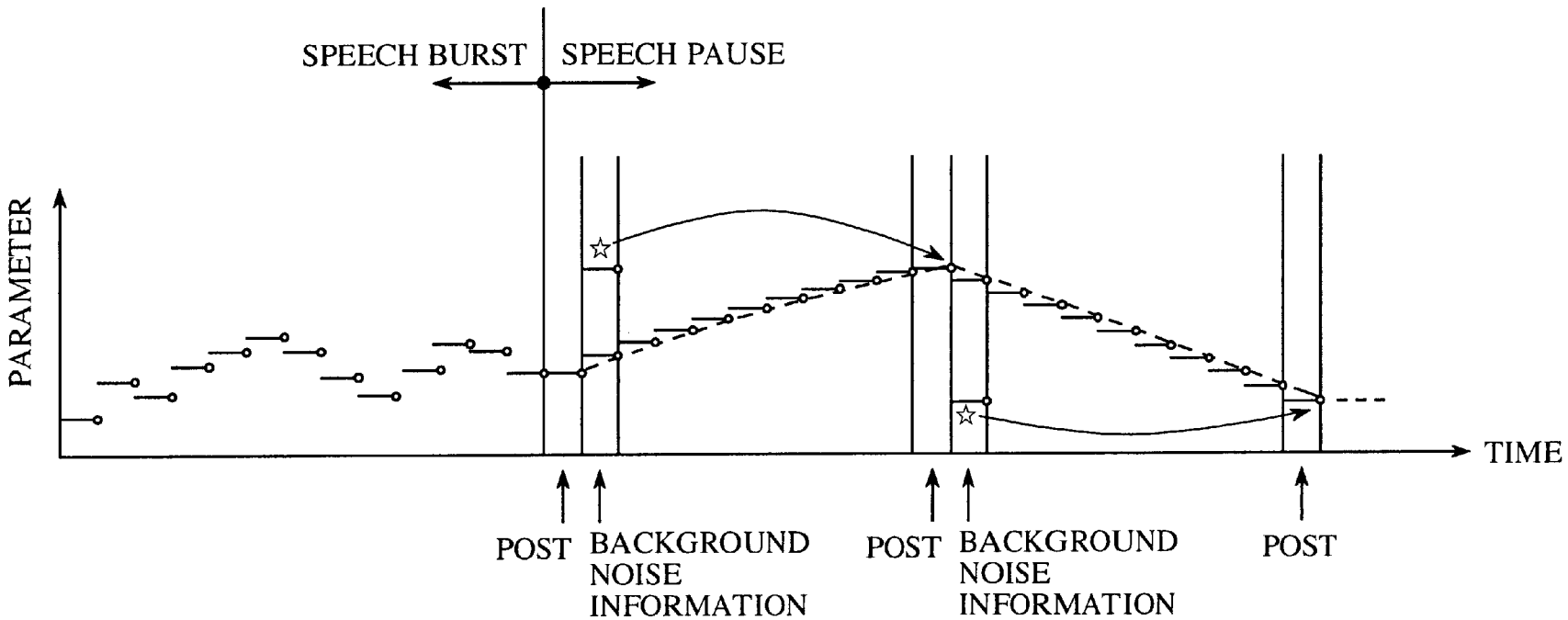
FIG.2 (PRIOR ART)
FIG. 2 is a diagram illustrating the linear interpolation of a speech spectrum coefficients which is the far-end talker background noise information.
Figure 3:
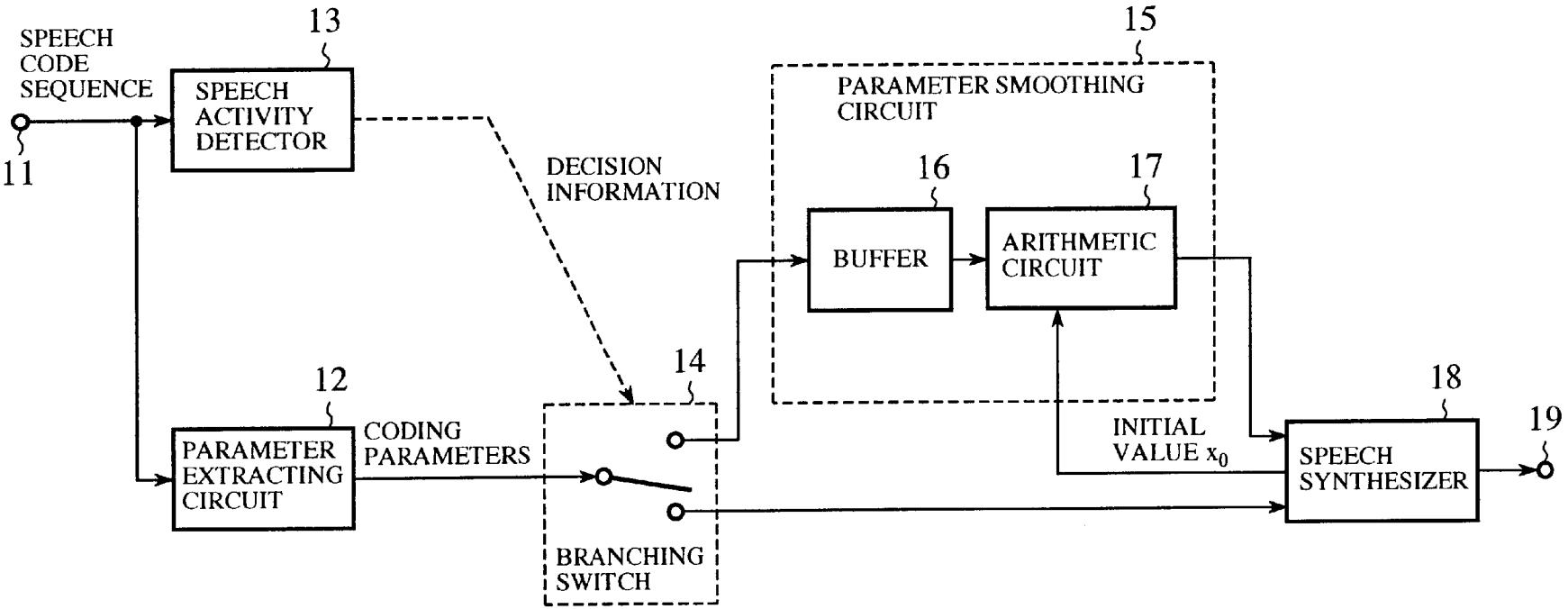
FIG. 3 is a block diagram showing a configuration of an embodiment 1 of the speech decoding unit in accordance with the present invention.

FIG. 3 is a block diagram showing a configuration of an embodiment 1 of the speech decoding unit in accordance with the present invention. In this figure, the reference numeral 11 designates an input terminal for inputting a speech code sequence; 12 designates a parameter extracting circuit (extracting means) for extracting coding parameters from the speech code sequence; 13 designates a speech activity detector (detecting means) for supervising the speech code sequence to detect a speech pause; and 14 designates a branching switch (detecting means) for switching the destination of the output of the parameter extracting circuit 12 in response to the decision information by the speech activity detector 13.

The reference numeral 15 designates a parameter smoothing circuit (estimating means) for estimating the coding parameters in the speech pause by carrying out the smoothing algorithm of the coding parameters by using the coding parameters constituting the far-end talker background noise information extracted by the parameter extracting circuit 12 and the coding parameters used for synthesizing the previous background noise; 16 designates a buffer for holding the coding parameters constituting the far-end talker background noise information; 17 designates an arithmetic circuit for carrying out the smoothing algorithm of the coding parameters by using the coding parameters constituting the far-end talker background noise information and the coding parameters used for synthesizing the previous background noise; 18 designates a speech synthesizer (synthesizing means) for synthesizing speech from the coding parameters estimated by the parameter smoothing circuit 15, or from the coding parameters extracted by the parameter extracting circuit 12; and 19 designates an output terminal.

Figure 4:
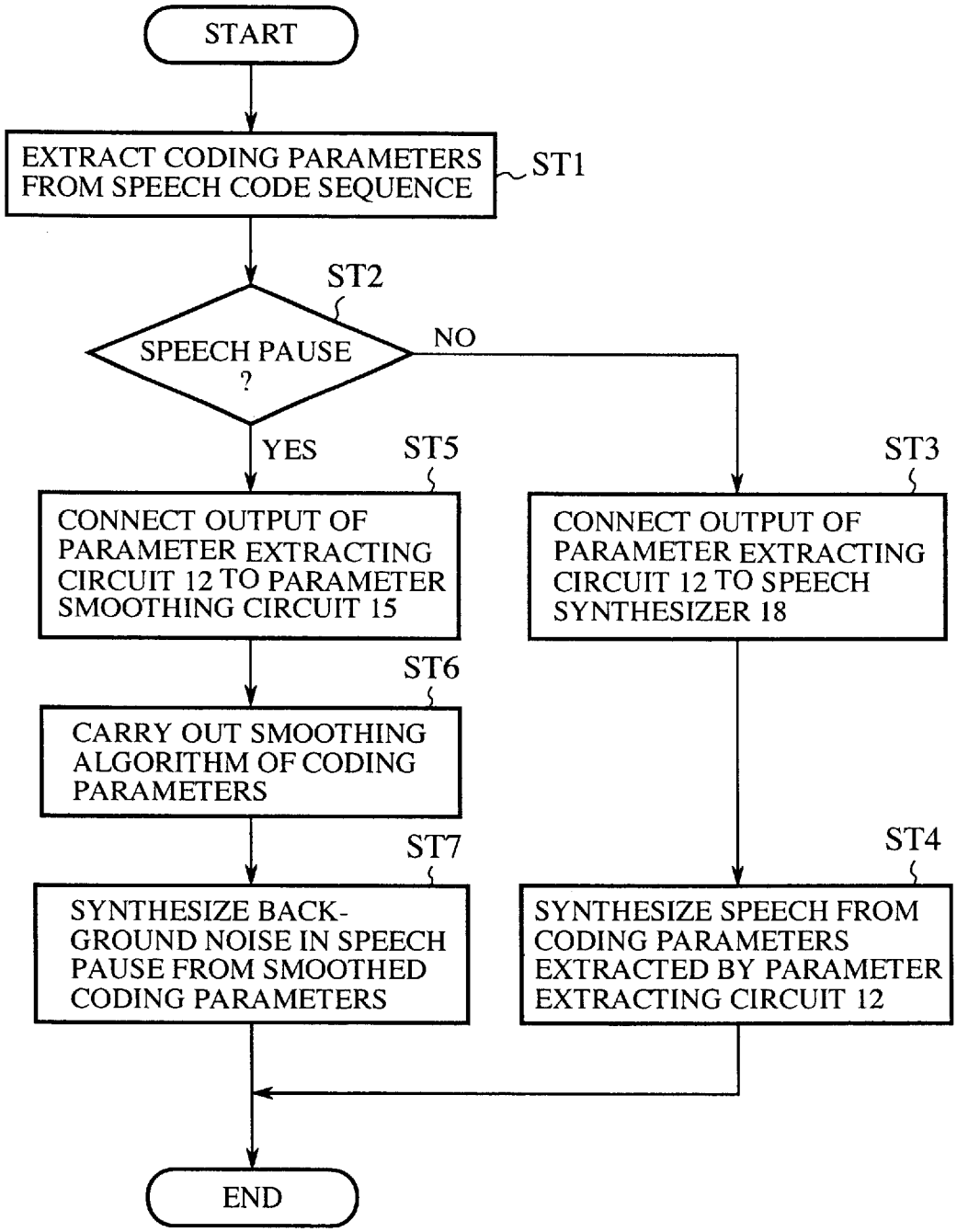
FIG. 4 is a flowchart illustrating a speech decoding method of the embodiment 1 in accordance with the present invention.

FIG. 4 is a flowchart illustrating a speech decoding method of the present embodiment 1 in accordance with the present invention.

Next, the operation of the present embodiment 1 will be described.

First, when a speech coder (not shown) detects speech of a far-end talker, it encodes the speech, and transmits the speech code sequence to the speech decoding unit.

When the speech of the far-end talker interrupts, the speech coder detects the speech pause of the far-end talker with an internal VOX (voice operated transmitter), and halts the transmission of the speech code sequence to the speech decoding unit. In this case, the speech coder transmits a unique word (post-amble POST) indicating the start of the speech pause, along with coding parameters indicating far-end talker background noise information.

In contrast, during a speech burst in which the speech of the far-end talker is detected, the speech coder transmits the speech code sequence, so that the parameter extracting circuit 12 of the speech decoding unit extracts the coding parameters from the speech code sequence (step ST1).

In addition, detecting the speech burst, the speech activity detector 13 that always supervises the speech code sequence controls the branching switch 14 such that it connects the output of the parameter extracting circuit 12 to the speech synthesizer 18 (steps ST2 and ST3).

When the speech burst starts because of the transition from the speech pause to the speech burst, the speech coder transmits a unique word called a preamble PRE so that the speech activity detector 13 can detect the start of the speech burst by detecting the unique word.

Then, the speech synthesizer 18 synthesizes the speech from the coding parameters extracted by the parameter extracting circuit 12, and supplies it to the output terminal 19, thereby reproducing the speech of the far-end talker (step ST4).

On the other hand, in the speech pause in which the speech of the far-end talker is not detected, although the speech coder halts the transmission of the speech code sequence, it transmits a unique word (post-amble POST) indicating the start of the speech pause, and coding parameters indicating the far-end talker background noise information, so that the parameter extracting circuit 12 of the speech decoding unit can extract the coding parameters from the speech code sequence (step ST1).

In addition, detecting a speech burst, the speech activity detector 13 that always supervises the speech code sequence controls the branching switch 14 such that it connects the output of the parameter extracting circuit 12 to the parameter smoothing circuit 15 (steps ST2 and ST5).

Figure 5:
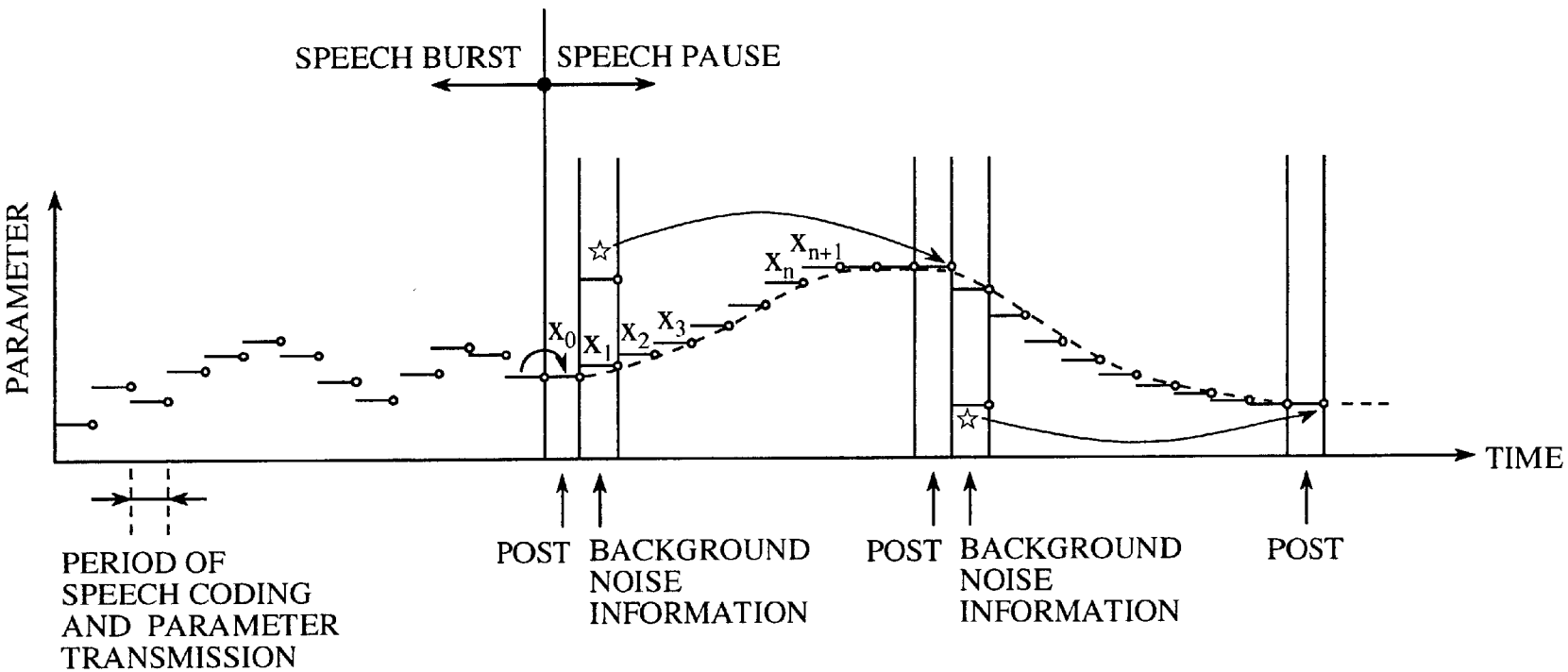
FIG. 5 is a diagram illustrating a smoothing algorithm of coding parameters constituting the far-end talker background noise information.

When a speech pause begins because of the transition from the speech burst to the speech pause, since the speech coder transmits the unique word called a post-amble POST as described above, speech activity detector 13 can detect the start of the speech pause by detecting the unique word (see, FIG. 5).

When the speech activity detector 13 detects the speech pause, the parameter smoothing circuit 15 carries out the smoothing algorithm of the coding parameters using the coding parameters constituting the far-end talker background noise information extracted by the parameter extracting circuit 12 and the coding parameters used for synthesizing the previous background noise, thereby estimating the coding parameters of the speech pause (step ST6).

If there is an acute difference between the speech code sequence received in the final receiving period of the speech burst and coding parameters constituting the far-end talker background noise information, the reproduced speech signal varies sharply, thereby presenting the problem of reproducing uncomfortable background noise to the near-end listener.

To prevent the acute change of the reproduced speech signal, the parameter smoothing circuit 15 carries out the smoothing algorithm of the coding parameters by substituting the coding parameters constituting the far-end talker background noise information extracted in succession to the post-amble POST and the coding parameters used for synthesizing the previous background noise.

$$x_{n+1}=(1-\alpha)\cdot x_n+\alpha\cdot x_{ref} \quad (1)$$

where $x_{n+1}$ is an estimated result of the coding parameters;

$x_n$ is a coding parameter used for synthesizing the previous background noise;

$x_{ref}$ is a coding parameter constituting the newly received far-end talker background noise information; and $\alpha$ is a smoothing coefficient of the coding parameters ($0<\alpha<<1$)

Thus, the coding parameters in the speech pause gradually increase or decrease in such a manner that they draw a conic (see, FIG. 5).

When the parameter smoothing circuit 15 carries out the smoothing algorithm of the coding parameters in this way, and estimates the coding parameters of the speech pause, the speech synthesizer 18 synthesizes the background noise in the speech pause from the estimated results of the coding parameters, and supplies the background noise to the output terminal 19 step ST7).

Here, as the initial value $x_0$ of the coding parameters, the coding parameters in the final receiving period of the speech burst is used. In addition, in the first receiving period in the speech pause, the speech synthesizer 18 synthesizes the speech from the coding parameters in the final receiving period of the speech burst. Accordingly, the same speech is reproduced in the final receiving period of the speech burst and in the initial receiving period of the speech pause.

As described above, the present embodiment 1 is configured such that it carries out the smoothing algorithm of the coding parameters using the coding parameters $x_{ref}$ constituting the far-end talker background noise information extracted by the parameter extracting circuit 12, and the coding parameters $x_n$ used for synthesizing the previous background noise, thereby estimating the coding parameters in the speech pause. Thus, the coding parameters in the speech pause increase and decrease in such a manner that they draw a conic, offering an advantage of being able to reproduce background noise with little uncomfortable feeling to the near-end listener.

Embodiment 2

Figure 6:
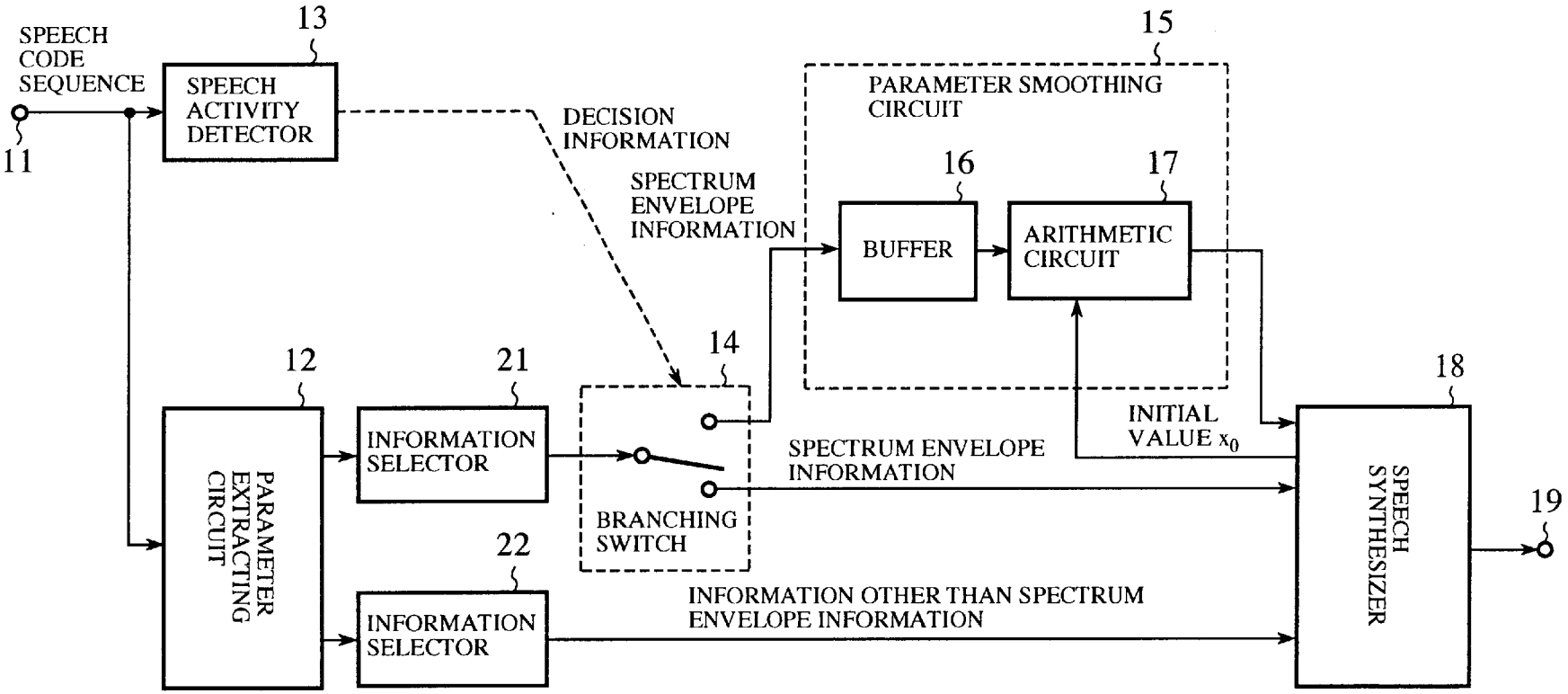
FIG. 6 is a block diagram showing a configuration of an embodiment 2 of the speech decoding unit in accordance with the present invention.

FIG. 6 is a block diagram showing a configuration of an embodiment 2 of the speech decoding unit in accordance with the present invention. In this figure, since the same reference numerals designate the same or like portions to those of FIG. 3, the description thereof it omitted here.

In FIG. 6, the reference numeral 21 designates an information selector for selecting only spectrum envelope information from the coding parameters extracted by the parameter extracting circuit 12; and 22 designates an information selector for selecting information other than the spectrum envelope information from the coding parameters extracted by the parameter extracting circuit 12.

Next, the operation of the present embodiment 2 will be described.

Although all the coding parameters are supplied to the parameter smoothing circuit 15 during the speech pause in the foregoing embodiment 1, only the spectrum envelope information in the coding parameters can be supplied to the parameter smoothing circuit 15, and the information other than the spectrum envelope information can be supplied to the speech synthesizer 18.

This offers an advantage of being able to reduce the amount of the algorithm when there are coding parameters unnecessary for the smoothing algorithm, because it is enough for the smoothing algorithm to process only the spectrum envelope information.

Embodiment 3

Although only the spectrum envelope information is subjected to the smoothing algorithm in the foregoing embodiment 2, only frame energy information can undergo the smoothing algorithm.

This offers not only an advantage similar to that of the foregoing embodiment 2, but also an advantage of being able to eliminate a problem in that the synthesized speech power changes intermittently in response to the variations in the frame energy of the background noise.

Embodiment 4

Figure 7:
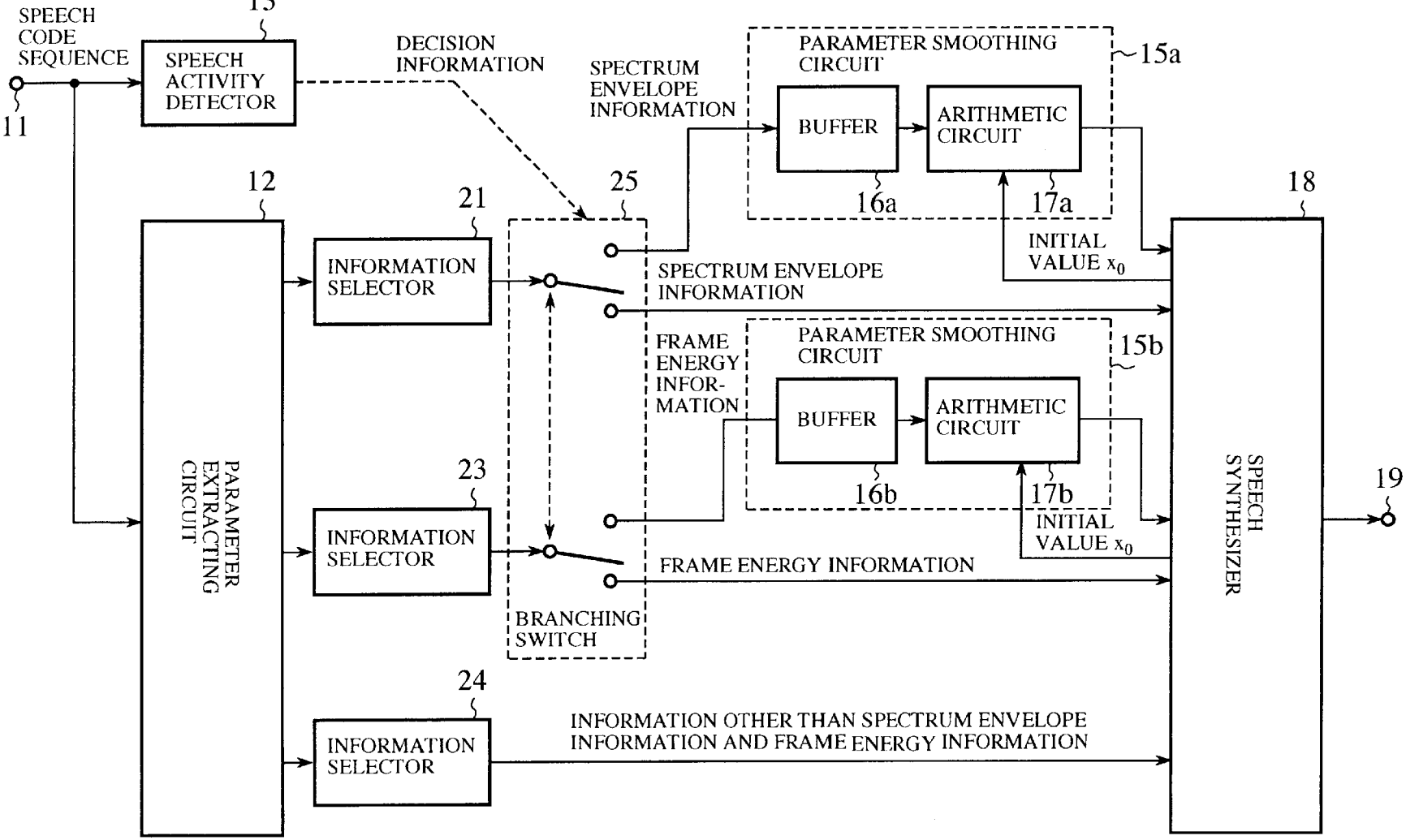
FIG. 7 is a block diagram showing a configuration of an embodiment 4 of the speech decoding unit in accordance with the present invention.

FIG. 7 is a block diagram showing a configuration of an embodiment 4 of the speech decoding unit in accordance with the present invention. In this figure, since the same reference numerals designate the same or like portions to those of FIG. 6, the description thereof it omitted here.

In FIG. 7, the reference numeral 23 designates an information selector for selecting and outputting only frame energy information from the coding parameters extracted by the parameter extracting circuit 12; 24 designates an information selector for selecting and outputting information other than the spectrum envelope information or the frame energy information from the coding parameters extracted by the parameter extracting circuit 12; 25 designates a branching switch (detecting means) for switching the destinations of the outputs of the information selectors 21 and 23 in response to the decision information of the speech activity detector 13; and 15*a* and 15*b* each designate a parameter smoothing circuit (estimating means) similar to the parameter smoothing circuit 15. The parameter smoothing circuit 15*a* carries out the smoothing algorithm of the spectrum envelope information, and the parameter smoothing circuit 15*b* carries out the smoothing algorithm of the frame energy information. The reference numerals 16*a* and 16*b* each designate a buffer; and 17*a* and 17*b* each designate an arithmetic circuit.

Next, the operation of the present embodiment 4 will be described.

Although either the spectrum envelope information or the frame energy information is subjected to the smoothing algorithm in the foregoing embodiments 2 and 3, both the spectrum envelope information and frame energy information can undergo the smoothing algorithm.

This offers an advantage of being able to further reduce the uncomfortable feeling about the background noise a near-end listener experiences than the foregoing embodiments 2 and 3, because both the spectrum envelope information and frame energy information are smoothed.

It goes without saying that the parameter smoothing circuits 15*a* and 15*b* can employ different smoothing coefficients a in accordance with the characteristics of the information used.

Embodiment 5

Figure 8:
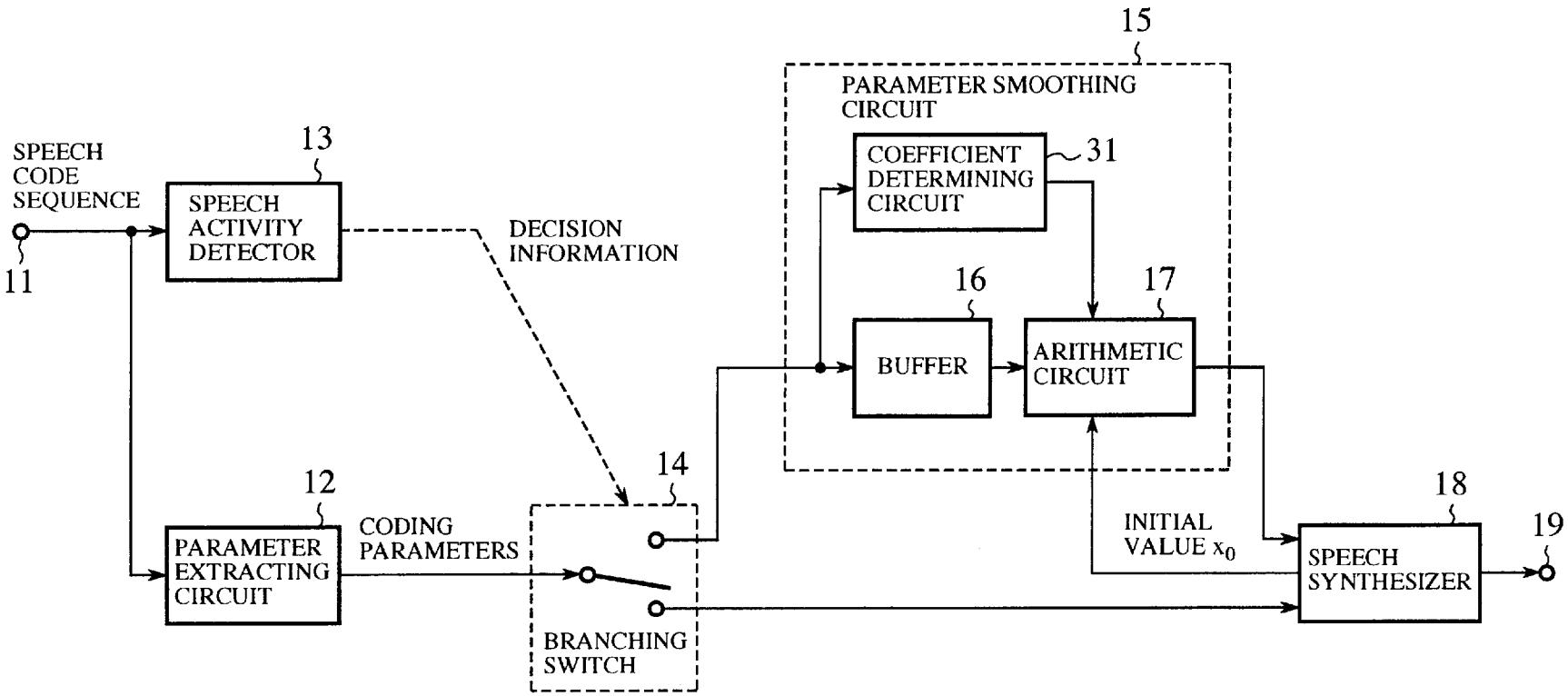
FIG. 8 is a block diagram showing a configuration of an embodiment 5 of the speech decoding unit in accordance with the present invention.

FIG. 8 is a block diagram showing a configuration of an embodiment 5 of the speech decoding unit in accordance with the present invention. In this figure, since the same reference numerals designate the same or like portions to those of FIG. 3, the description thereof it omitted here.

In FIG. 8, the reference numeral 31 designates a coefficient determining circuit for determining a smoothing coefficient α of the coding parameters in response to the variations between the coding parameters extracted by the parameter extracting circuit 12 in the final receiving period of the speech burst and the coding parameters constituting the far-end talker background noise information extracted by the parameter extracting circuit 12 in the receiving period of the speech pause.

Next, the operation of the present embodiment 5 will be described.

Although the smoothing coefficient α of the coding parameters is set at an arbitrary value ($0<\alpha<<1$) in the foregoing embodiments 1–4, it can be determined in response to the variation between the coding parameter $x_0$ extracted from the final receiving period of the speech burst and the coding parameter $x_{ref}$ constituting the newest far-end talker background noise information extracted from the receiving period in the speech pause.

More specifically, when the variation is large (as when the regulation exceeds 80%), the smoothing coefficient α is made smaller than a normal value (for example, the smoothing coefficient α is set at 0.05). In contrast, when the variation is small (as when the regulation is equal to or less than 80%), the smoothing coefficient α is placed at the normal value (for example, the smoothing coefficient α is set at 0.1).

When the speech pauses continue, the smoothing coefficient α of the coding parameters is determined in response to the variations in the previous background noise information and current far-end talker background noise information.

This offers an advantage of being able to reproduce background noise with less uncomfortable feeling because of more appropriate smoothing coefficient α of the coding parameters.

Embodiment 6

Figure 9:
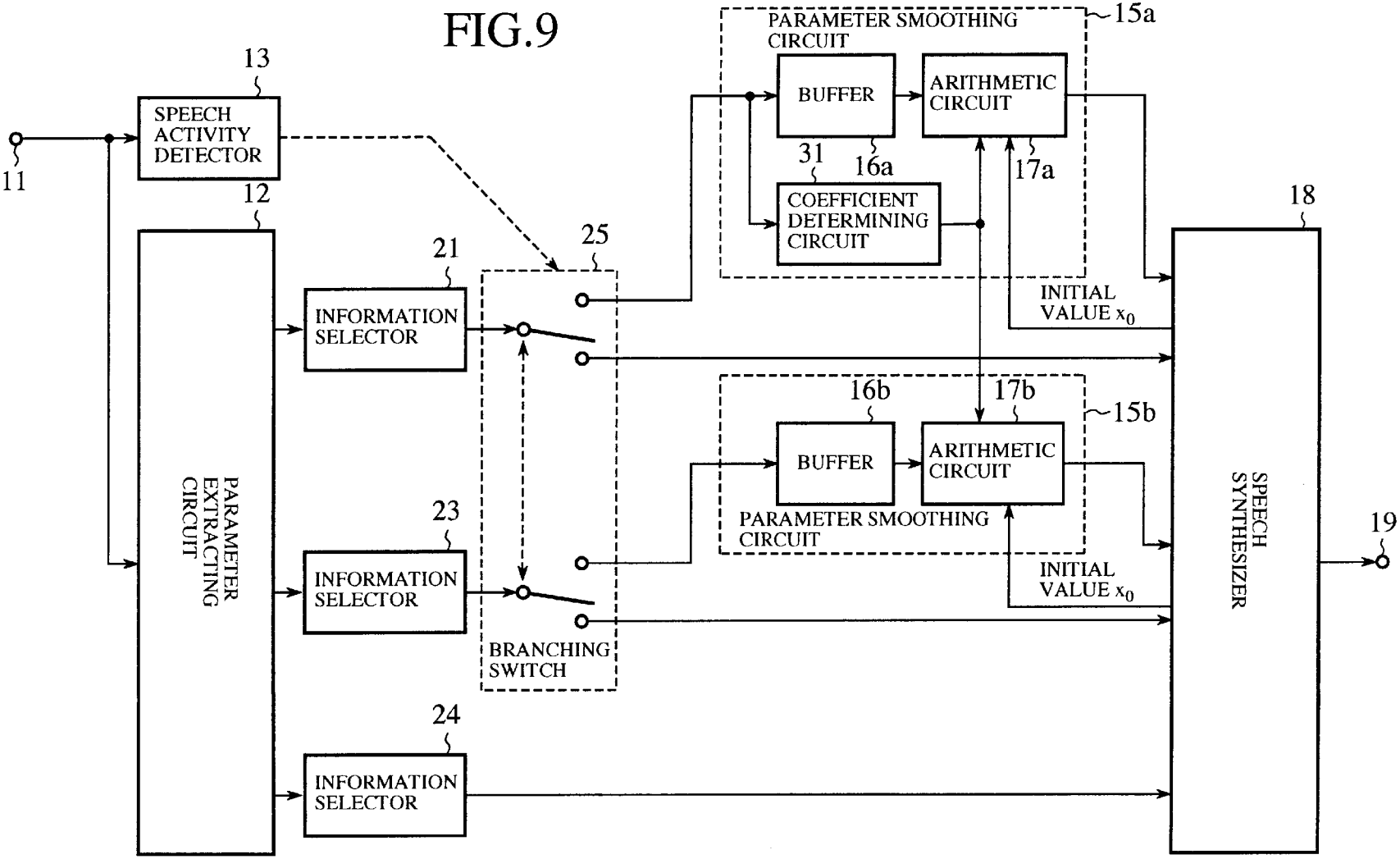
FIG. 9 is a block diagram showing a configuration of an embodiment 6 of the speech decoding unit in accordance with the present invention.

Although the smoothing coefficient α of the coding parameters is determined depending on the variations between the coding parameters in the foregoing embodiment 5, this is not essential. For example, when both the spectrum envelope information and frame energy information are smoothed as in the foregoing embodiment 4, it is possible as shown in FIG. 9 to determine the smoothing coefficient α of the spectrum envelope information (the smoothing coefficient α used by the arithmetic circuit 17*a*) in response to the variation between the spectrum envelope information (coding parameters) extracted from the final receiving period of the speech burst and the spectrum envelope information (coding parameters) constituting the far-end talker background noise information extracted from the receiving period of the speech pause, and then to determine the smoothing coefficient α of the frame energy information (the smoothing coefficient α used by the arithmetic circuit 17*b*) such that it becomes equal to the smoothing coefficient α of the spectrum envelope information.

This offers an advantage of being able to reproduce background noise with little uncomfortable feeling without imposing a large load on the decision processing of the smoothing coefficient α of the frame energy information because the smoothing coefficient α of the frame energy information can be determined without carrying out its decision processing.

Incidentally, it is also possible to carry out the decision processing of the smoothing coefficient α of the frame energy information, first, and then the smoothing coefficient α of the spectrum envelope information can be made equal to the smoothing coefficient α of the frame energy information.

Embodiment 7

Figure 10:
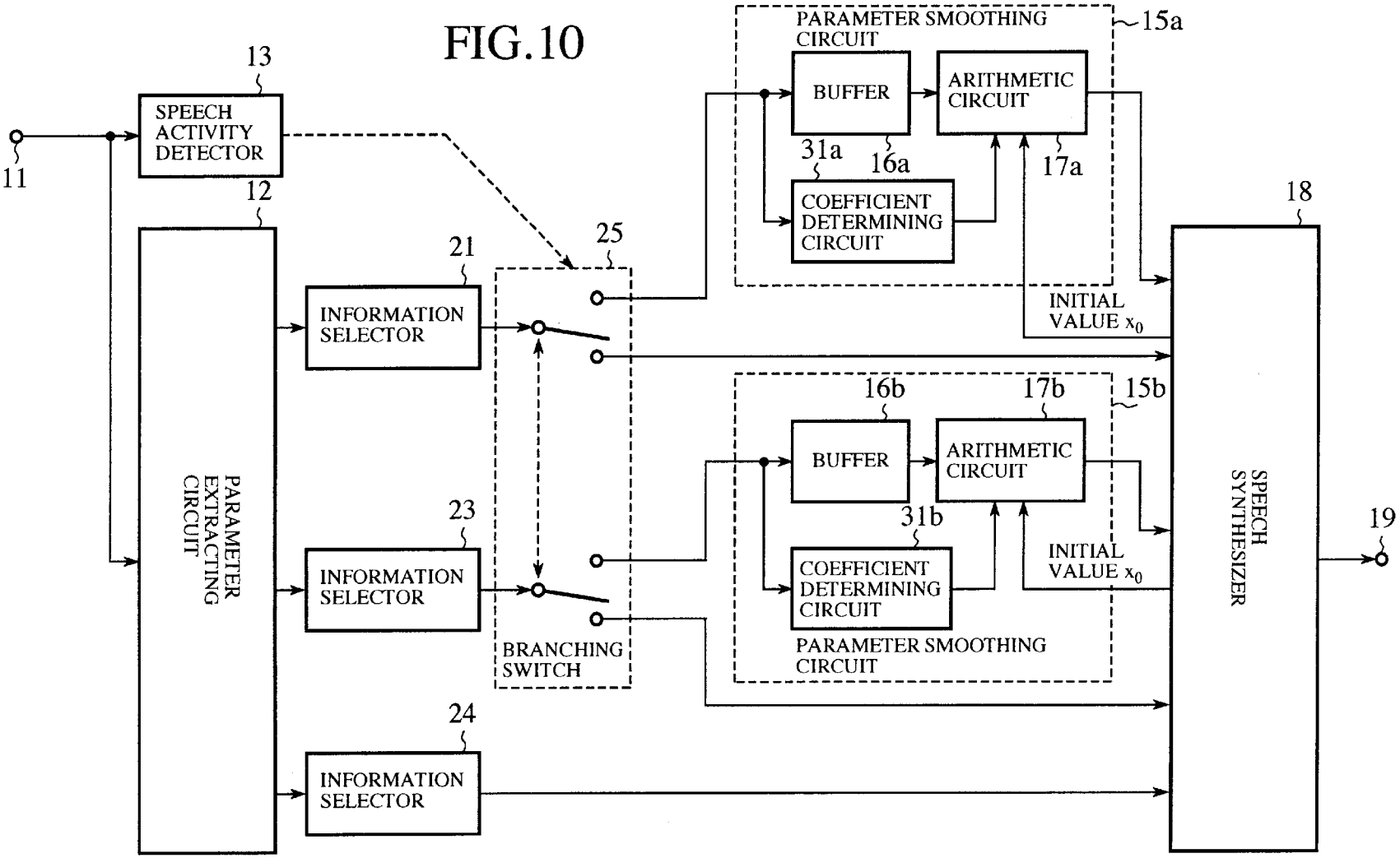
FIG. 10 is a block diagram showing a configuration of an embodiment 7 of the speech decoding unit in accordance with the present invention.

Although both the smoothing coefficient α of the spectrum envelope information and the smoothing coefficient α of the frame energy information are determined in response to the variation in the spectrum envelope information or in the frame energy information in the foregoing embodiment 6, it is also possible as shown in FIG. 10 to determine the smoothing coefficient α of the spectrum envelope information in response to the variation in the spectrum envelope information, and the smoothing coefficient α of the frame energy information in response to the variation in the frame energy information, by installing coefficient determining circuits 31*a* and 31*b* (that operate just as the coefficient determining circuit 31) in the parameter smoothing circuits 15*a* and 15*b*, respectively.

This offers an advantage of being able to reproduce background noise with less uncomfortable feeling than the foregoing embodiment 6 because the smoothing coefficients a can be determined more suitably depending on the characteristics of the individual information.

Embodiment 8

Although the smoothing coefficient α is fixed until the next update period of the far-end talker background noise information in the foregoing embodiments 1–7, the smoothing coefficient α can be continuously updated at every processing frame interval.

Embodiment 9

Although the smoothing algorithm (smoothing algorithm of the AR smoothing) is carried out using equation (1) in the foregoing embodiments 1–8, this is not essential, but any other smoothing algorithms can be utilized.

This offers an advantage of being able to reproduce more reliable background noise than the embodiments that use only one smoothing algorithm, because it becomes possible to use smoothing algorithm more suitable for each parameter considering the dynamic range or statistical occurrence probability of the parameters to be smoothed.

As described above, the speech decoding unit and speech decoding method in accordance with the present invention are applicable to reproduce the speech of a far-end talker in the speech bursts in which the speech of the far-end talker is present, and to reproduce background noise in the speech pauses in which the speech of the far-end talker is not present.

What is claimed is:

1. A speech decoding unit comprising:

extracting means for extracting coding parameters from a speech code sequence;

detecting means for detecting a speech pause by supervising the speech code sequence;

estimating means for estimating, when said detecting means detects the speech pause, coding parameters of the speech pause by carrying out a smoothing algorithm of coding parameters constituting far-end talker background noise information extracted by said extracting means and coding parameters used for synthesizing previous background noise; and synthesizing means for synthesizing background noise in the speech pause from the coding parameters estimated by said estimating means.

2. The speech decoding unit according to claim 1, wherein said estimating means substitutes the coding parameters constituting the far-end talker background noise information and the coding parameters used for synthesizing the previous background noise into the following equation to estimate the coding parameters of the speech pause:

$$x_{n+1}=(1-\alpha)\cdot x_n+\alpha\cdot x_{ref}$$

where $x_{n+1}$ is an estimated result of the coding parameters; $x_n$ is a coding parameter used for synthesizing the previous background noise; $x_{ref}$ is a coding parameter constituting the far-end talker background noise information; and $\alpha$ is a smoothing coefficient of the coding parameters, where $0<\alpha<<1$.

3. The speech decoding unit according to claim 1, wherein said synthesizing means synthesizes, in an initial receiving period of the speech pause, speech from coding parameters extracted in a final receiving period of a speech burst by said extracting means.

4. The speech decoding unit according to claim 1, wherein said estimating means carries out the smoothing algorithm of spectrum envelope information constituting a part of the coding parameters.

5. The speech decoding unit according to claim 1, wherein said estimating means carries out the smoothing algorithm of frame energy information constituting a part of the coding parameters.

6. The speech decoding unit according to claim 1, wherein said estimating means carries out the smoothing algorithm of spectrum envelope information and frame energy information constituting a part of the coding parameters.

7. The speech decoding unit according to claim 1,-wherein said estimating means determines a smoothing coefficient of the coding parameters in response to variations between the coding parameters extracted by said extracting means in a final receiving period of a speech burst and the coding parameters constituting the far-end talker background noise information extracted by said extracting means in a receiving period of the speech pause.

8. The speech decoding unit according to claim 1, wherein said estimating means determines, when carrying out smoothing algorithm of spectrum envelope information and frame energy information, a smoothing coefficient of the coding parameters in response to variations between the spectrum envelope information extracted in a final receiving period of a speech burst and the spectrum envelope information constituting the far-end talker background noise information, or in response to variations between the frame energy information extracted in the final receiving period of the speech burst and the frame energy information constituting the far-end talker background noise information.

9. The speech decoding unit according to claim 1, wherein said estimating means determines, when carrying out smoothing algorithm of spectrum envelope information and frame energy information, a smoothing coefficient of the spectrum envelope information in response to variations between the spectrum envelope information extracted in a final receiving period of a speech burst and the spectrum envelope information constituting the far-end talker background noise information, and a smoothing coefficient of the frame energy information in response to variations between the frame energy information extracted in the final receiving period of the speech burst and the frame energy information constituting the far-end talker background noise information.

10. A speech decoding method comprising the steps of:

detecting a speech pause by supervising a speech code sequence;

estimating, when the speech pause is detected, coding parameters of the speech pause by carrying out a smoothing algorithm of coding parameters by using coding parameters constituting far-end talker background noise information extracted from the speech coding sequence and coding parameters used for synthesizing previous background noise; and synthesizing background noise in the speech pause from the coding parameters estimated.

11. The speech decoding method according to claim 10, wherein the coding parameters in the speech pause are estimated by substituting the coding parameters constituting the far-end talker background noise information and the coding parameters used for synthesizing the previous background noise into the following equation:

$$x_{n+1}=(1-\alpha)\cdot x_n+\alpha\cdot x_{ref}$$

where $x_{n+1}$ is an estimated result of the coding parameters; $x_n$ is a coding parameter used for synthesizing the previous background noise; $x_{ref}$ is a coding parameter constituting the far-end talker background noise information; and $\alpha$ is a smoothing coefficient of the coding parameters, where $0<\alpha<<1$.

12. The speech decoding method according to claim 10, wherein in an initial receiving period of the speech pause, speech is synthesized from the coding parameters extracted in a final receiving period of a speech burst.

13. The speech decoding method according to claim 10, wherein a smoothing coefficient of the coding parameters is determined in response to variations between the coding parameters extracted in a final receiving period of a speech burst and the coding parameters constituting the far-end talker background noise information extracted in a receiving period of the speech pause.

* * * * *